US005605738A

United States Patent [19]

McGinness et al.

[11] Patent Number: 5,605,738

[45] Date of Patent: Feb. 25, 1997

[54] TAMPER RESISTANT SYSTEM USING ULTRAVIOLET FLUORESCENT CHEMICALS

[75] Inventors: William G. McGinness, Burlington, Ky.; Louis Liang, Los Altos, Calif.

[73] Assignee: Angstrom Technologies, Inc., Erlanger, Ky.

[21] Appl. No.: 130,095

[22] Filed: Sep. 30, 1993

[51] Int. Cl.[6] ..... B41M 3/14

[52] U.S. Cl. ..... 428/195; 250/365; 250/372; 283/92; 283/94; 427/7; 427/265; 428/484; 428/690; 428/916

[58] Field of Search ..... 250/365, 372; 283/92, 94; 427/7, 261; 428/195, 690, 915, 916

[56] References Cited

U.S. PATENT DOCUMENTS

| | | | |
|---|---|---|---|
| Re. 27,770 | 10/1973 | Siegel | 235/61.11 E |
| 3,833,395 | 9/1974 | Gosnell | 117/1 |
| 3,922,435 | 11/1975 | Asnes | 428/349 |
| 4,146,792 | 3/1979 | Stenzel et al. | 250/365 |
| 4,186,020 | 1/1980 | Wachtel | 106/22 |
| 4,451,530 | 5/1984 | Kaule et al. | 428/323 |
| 4,627,642 | 12/1986 | Peronneau et al. | 283/92 |

OTHER PUBLICATIONS

"Photochromic Papers or Filmes for Noncopyable Documents," by Japan Tokkyo Koho JP 8553981, Mar. 1989.

*Primary Examiner*—B. Hamilton Hess

*Attorney, Agent, or Firm*—Majestic, Parsons, Siebert & Hsue

[57] ABSTRACT

A release agent is first applied to a target article and on top of the release agent is applied an ultraviolet radiation fluorescent material to enable fraud detection. To prevent fraud, a security label may also be used comprising a label substrate, a release layer, a layer of ultraviolet radiation fluorescent material, and an adhesive layer for adhering to a target article. When the substrate is peeled off, part of the ultraviolet sensitive material will be peeled off also to enable detection.

24 Claims, 7 Drawing Sheets

TAMPER RESISTANT SYSTEM USING ULTRAVIOLET FLUORESCENT CHEMICALS

BACKGROUND OF THE INVENTION

This invention relates to a security system that is tamper resistant and can be detected with automated means such as scanners, readers and detectors. More specifically, it relates to ultraviolet (UV) fluorescent chemistry for additional security protection. In the preferred embodiment, frequency specific, insoluble UV chemicals may be used as well to further improve security.

In recent years, counterfeits and forgery have become increasingly severe problems for major name brand manufacturers, governments, banking and financial industry. The rapid growth in popularity for flea markets, bartering, underground discount vendors, and gray markets, fueled by worldwide recessions and illicit traffic create strong demands for technologies and systems that can deter and detect counterfeit. Additionally, security protection devices are preferably machine readable to reduce dependency on subjective human judgment while providing cost saving in labor through automated processing.

Presently, the state of art security protection devices typically use visible means. Three-dimensional holographic labels, micro-dot printing, or "rotogravure dot patterns," self-destructive labels, tamper resistant tags and bar codes, and other machine readable codes, etc., are all visible. With the exception of bar codes, verification typically relies on human subjective judgment making counterfeit or copying relatively easy and authentication prone to errors. They also require additional space in the product or packaging for placement and, therefore, could interfere with the artistic layout of the product or packaging. Many of them can be removed, replaced and re-applied without discrimination, therefore reducing their effectiveness as high security counterfeit protection devices. More importantly, the advanced color copier and computer graphic technologies can reproduce practically any visible printing making counterfeit proof security systems and detection almost impossible.

Electronic means, such as magnetic strips, surface acoustic wave devices, micro chips, smart cards, etc., offer excellent encryption capability and can be fully automated for authentication and processing. The problems are that they tend to be more bulky in size, more susceptible to environmental interference, more expensive, and less robust.

Infrared-based systems, on the other hand, overcome many of the shortcomings described earlier. They are invisible and have encryption capability. They are also relatively low cost and non-removable. While authentication can be easily automated, their total invisibility makes consumer education rather difficult and do not provide a quick and inexpensive way for first order identification in the field.

Visible erase-detectable paper and security labels have been around for some time. Most notable is "water-mark" paper where patterns become smeared if it is exposed to fluid or erased. Recently, advanced synthetic paper fabric such as Teslin (silica-filled polyolenfinic media) which wrinkles upon erasing mechanically. However, most such devices, for example, laser printed patterns, "water marks, " and including Teslin can be erased without blemish with chemicals as simple as alcohol. The patterns can then be reconstructed or touched up again with matching "visible" ink.

As far as security labels are concerned, there are several manufacturers who produce labels that will be deformed, damaged, destroyed, upon removal or tampering. Similarly, UV-sensitive materials have been used as invisible marking of various types. See, for example, Green, Miller U.S. Pat. No. 4,889,367; Duret U.S. Pat. No. 4,605,846.

UV-based technologies, on the other hand, overcome most of the shortcoming described above. They are machine-readable, can be partially visible or invisible, and current advanced copying machine and computer graphic technologies cannot be used to copy UV sensitive materials because UV spectrum is beyond the visible range of almost all vision-based technologies. It is, therefore, highly desirable to apply UV-based technologies for security protection for many products. However, typical patterns printed with UV inks today are not erasable.

SUMMARY OF THE INVENTION

This invention is based on the observation that if a material which fluoresces in response to ultraviolet radiation is so applied in a tamper resistant system that the material will be completely or partially erased when tampered with, this renders authentication and detection of tampering easier. One aspect of the invention is directed towards a method for marking articles for enabling the detection of fraud through tampering of articles. The method comprises applying a first layer of a release agent over the article and forming a second layer of a material in a predetermined first pattern over the release agent layer. The material fluoresces in response to ultraviolet radiation, so that tampering is detectable when any of the material is erased.

Another aspect of the invention is directed towards a tamper resistant structure on articles for enabling the detection of fraud through tampering of articles. The structure comprises a layer of release agent over the article and a layer of material in a predetermined pattern over the release agent layer. The material fluoresces in response to ultraviolet radiation. By marking a target article with the structure, the erasure of any portion of the material can be detected by means of an UV scanner for enabling the detection of fraud through tampering of the article.

Yet another aspect of the invention is directed towards a method for making a tamper resistant security label. The method comprises providing a label substrate, applying a release coating over the substrate and applying a layer of material over the coating in a pattern. The material fluoresces in response to ultraviolet radiation. The method further comprises applying an adhesive layer over the layer of material. Thus, when this label is applied to any article by placing the adhesive layer in contact with the article, any attempt to tamper with the label substrate will cause the pattern of the UV-sensitive material to be removed or altered, thereby enabling the detection of tampering of the label on the article.

Another aspect of the invention is directed towards a tamper resistant label for use on articles for enabling the detection of fraud when the label is tampered with. The label comprises a label substrate, a release coating over the substrate, and a layer of material over the coating in a pattern. The material fluoresces in response to ultraviolet radiation. The label further comprises an adhesive layer over the layer of UV sensitive material. In some applications, it may be desirable to apply the above-described tamper resistant label over the above-described tamper resistant structure on an article where the pattern of UV-sensitive material of the label matches that of the UV-sensitive material in the tamper resistant structure underneath the label. Such structure and method of application would be particularly effective if the label and the tamper resistant structure are separated by a layer of ink for authenticating the article, such as a signature on a bank check. The signature ink would then obscure a portion of the pattern of the tamper resistant structure underneath, but is covered by the matching pattern of the label. Therefore, when the label is removed or altered in order to change the signature, this will affect the matching of the patterns between the tamper resistant structure and the overlying label, thereby rendering fraud through tampering particularly difficult and at the same time rendering fraud through tampering easy to detect.

BRIEF DESCRIPTION OF THE DRAWINGS

For simplicity in description, identical components in different figures of this application are identified by the same numerals.

DETAILED DESCRIPTION OF THE PREFERRED EMBODIMENT

Figure 1A:
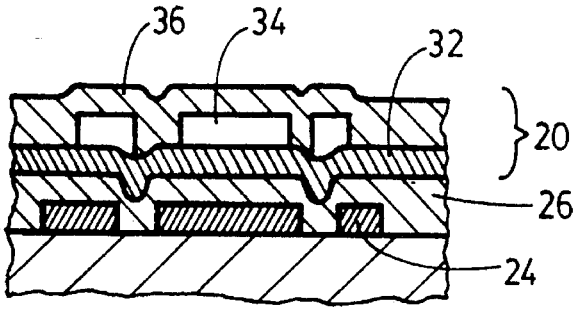
FIG. 1A is a cross-sectional view of a tamper resistant structure that can be placed on articles for enabling the detection of fraud.
Figure 1B:
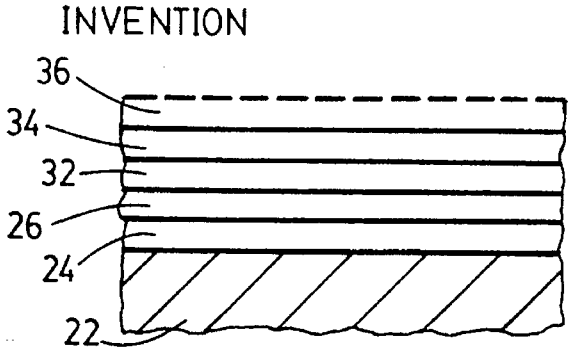
FIG. 1B is a schematic representation of the structure of FIG. 1A to illustrate the method for making such structure.

One aspect of the invention is based on the recognition that, by applying an erasable pattern of UV-sensitive material on a target article or document, detection of fraud through tampering can be detected if the UV-sensitive pattern is altered or removed. This aspect of the invention is illustrated in FIGS. 1A, 1B. FIG. 1A is a cross-sectional view of a tamper resistant structure that may be applied to a target article or document to enable detection of fraud such as when the article or document is tampered with. FIG. 1B is a schematic diagram illustrating a method for making the structure of FIG. 1A.

As shown in FIG. 1A, a structure 20 is applied or formed on a target article or document 22. Frequently, article 22 has printed thereon a visible printed image. For target articles such as merchandise, such printed image may be the brand name or other marketing related information. For target documents such as bank checks, such printed image may identify the name of the bank and names and address of the person signing the check as well as other information. Such visible printed image is illustrated by the layer of ink 24 on article 22. Depending upon the texture of the surface of article 22 as well as the nature of the ink 24, an optional overcoat varnish or sealer 26 is applied on top of the ink layer as the finishing layer to prevent smearing of the ink layer. The tamper resistant structure 20 is formed on top of the overcoat varnish or sealer finishing layer 26. Alternatively, if the texture of the surface of article 22 and ink 24 are such that no overcoat finishing is required, structure 22 may be formed directly on top of the ink layer 24 and the surface of article 22. As yet another alternative, if no visible printed image is present on article 22, structure 20 may be formed directly on the surface of article 22; this is also the case if structure 20 is formed on an area of article or document 22 without any images. In all these variations, structure 20 will function to enable fraud to be easily detected; all such variations are within the scope of the invention.

Structure 20 is preferably transparent and includes a layer 32 comprising a release agent such as waxes, polyolefins, non-vinyl varnish or sealers with release characteristics. A layer of UV-sensitive material 34 is then formed on top of layer 32 of release agent. Preferably, layer 34 forms a predetermined pattern for easy identification and authentication. Then an optional additional overcoat varnish layer 36 is formed over layer 34 as shown in FIG. 1A. Thus, when fraud is attempted, the nature of material of the release layer 32 renders portions of layer 34 to be easily removable when attempt is made to alter layer 34, including the pattern formed thereby. Portions of layer 34 may be removed or the pattern formed thereby may be disturbed when attempts are made to erase layer 34 mechanically or with chemicals. It would be difficult for someone to reconstruct structure 20 after erasure either mechanically or by chemical means. To prevent layer 34 from being accidentally and unintentionally disturbed, an additional optional overcoat varnish layer 36 may be formed on top of layer 34 to protect it.

In FIG. 1A, layer 32 is formed on varnish layer 26. Layer 34 is formed on top of layer 32, and layer 36 is formed on top of layers 34 and 32. It will be understood, however, that the above-described advantages will be present even though there may be layers separating layers 26, 32, separating layers 32, 34, and separating layers 34, 32 and 36, it being sufficient that layer 32 be formed over the article, that layer 34 be formed over layer 32, and layer 36 be formed over layers 32 and 34. All such variations are within the scope of the invention.

A method for forming the structure of FIG. 1A is illustrated schematically in FIG. 1B. First, an optional visible printed image is formed by applying ink layer 24 on article 22. Then an optional overcoat varnish or sealer finishing layer 26 is applied over layer 24 and article 22. As discussed above, either one or both of layers 24 and 26 are optional. Then a layer 32 of release agent is formed over 22. If either one of or both layers 24 and 26 are present, then layer 32 may be formed on top of either one or both. Next, a layer 34 of UV-sensitive material, preferably forming a predetermined pattern, is applied over layer 32. Lastly, an additional optional overcoat varnish layer 36 is applied over layers 34 and 32 to prevent accidental erasure. Additional layers may be formed between any pair of contiguous layers shown in FIG. 1B. All of the above-described layers may be applied through a conventional printing process such as offset, ink jet, or other processes, all known to those skilled in the art and will not be described in detail herein. As noted above, layer 32 of release agent may be a wax, polyolefins, non-vinyl varnish or sealers. All such materials may be applied conveniently through a conventional printing process.

Layer 34 includes an ultraviolet radiation fluorescent chemical. The method of application includes preparing a suspension of such chemical. The suspension can be prepared by suspending the chemical in an oleoresinous varnish printing vehicle, or in a petroleum-based or organic wax printing vehicle. The suspension is then printed onto layer 32 using a conventional printing process. A portion of the printing vehicle evaporates, leaving the ultraviolet radiation fluorescent chemical and a residue of the printing vehicle.

To provide additional security to the system, the ultraviolet radiation fluorescent chemical used emits light of very specific frequencies in response to ultraviolet radiation. Therefore, even if counterfeiters are successful in reproducing the patterns with similar UV chemicals, they may not be able to duplicate the specific frequency response of layer 34 which is much more difficult to reproduce. Sophisticated UV scanners are capable of detecting minor alteration to the signature of UV chemicals by detecting the frequencies of light emitted by the chemicals in response to ultraviolet radiation. One type of frequency specific UV material (i.e., emitting light of specific frequencies in response to ultraviolet radiation) are compounds 4 and 6 from Angstrom Technologies, Inc. of Florence, Ky. The ultraviolet radiation fluorescent chemical used herein is preferably organic and indissolvable in ordinary printing vehicles or carriers. Thus, the chemical particles are suspended in the printing vehicle or carrier. The organic and indissolvable nature of the ultraviolet radiation fluorescent chemical makes it more difficult for counterfeiters to duplicate. Oleoresinous type varnish can be printed on just like ink. Resin-based varnishes such as oleoresinous-type varnish are typically more resistant to solvents such as organic-based solvents, making it more stable when solvents are accidentally spilled. Such resin-based varnishes are easily erasable, so that together with the erasability of the underlying release layer 32, such varnishes render layer 34 easily erasable when tampered with.

Layer 32 of UV-sensitive material comprising an ultraviolet radiation fluorescent chemical and residue of a printing vehicle may be transparent and invisible in the absence of ultraviolet light; the chemical is preferably organic and insoluble which are characteristic of compounds 4 and 6 from Angstrom Technologies, Inc. referenced above. In some situations, it may be desirable for layer 32 to be partially visible, such as when layer 34 has a hue while remaining transparent. When layer 34 has such quality, it is referred to herein as being "partially visible." Partial visibility of layer 34 has the advantage of having the same level of security protection from reproduction by counterfeiters as an invisible layer using UV scanners or black light, while providing the ease of first level identification without needing UV scanners or a black light source. However, for refined verification, a UV scanner or other sources and detectors may be necessary. When the suspension used for printing layer 34 is loaded with 5% or more of chemical, after layer 34 dries, the material in layer 34 becomes partially visible in the absence of ultraviolet radiation. It is also possible to load the suspension for printing layer 34 with visible chemical so that the material in layer 34 is visible under ordinary lighting conditions.

The oleoresinous varnish printing vehicle or carrier may be a polymeric, aliphatic, aromatic and esterification of fatty acids with aqueous emulsions and water, to which a small percentage (1–10%) of petroleum-based or organic wax is added. Typically, the synthetic wax has molecular weight of up to 20,000. It is basically polymeric glycol, such as 20 M Wax from Union Carbide, where the wax also acts as a temporary bonding agent to coating 36 as well as the release agent for the pigment and dye in layer 34 when chemical, physical or thermal forces are exerted on layer 34 to alter it. Preferably, the suspension resulting in layer 34 is printed with certain patterns, preferably ones that can be easily identified if tampered. Examples are continuous wavy lines or grids, such as those shown in FIG. 11B. Being invisible or only partially visible in normal ambient light environment, the security patterns formed by layer 34 cannot be duplicated even with advanced color copier or computer graphic technologies. Detection is made with UV scanners or UV black light sources. If the patterns formed by layer 34 are broken, missing, distorted, damaged, the article has been tampered with.

There are a number of ways for controlling the partial visibility of layer 34.

(1) Partial visibility may be controlled by varying the loading of ultraviolet radiation fluorescent chemical in the suspension used for printing layer 34. For example, 2–3% loading printed on paper media typically will be invisible. By increasing the loading to, for example, 5 or 6%, it will be partially visible.

(2) The chemical may be rendered visible by increasing the particle size of the chemical used. For example, compound 6 from Angstrom Technologies, Inc. has a particle size of approximately 4–6 microns in diameter. If the particle size is increased by a process such as agglomeration to about 15–25 microns in layer 34, then layer 34 may be partially visible.

(3) If layer 34 is printed on top of finishing overcoating varnish or printed materials, such as layer 26, layer 34 may be partially visible even if the suspension used for printing layer 34 has less than 5 or 6% loading of the ultraviolet radiation sensitive chemical.

(4) Layer 34 may be rendered partially visible by adding a small amount of visible chemical in addition to the ultraviolet radiation's fluorescent chemical. Thus, the visible chemical used may be 5–10% by weight of that of the ultraviolet radiation fluorescent chemical, such as compound 6 from Angstrom Technologies, Inc.

(5) If no layer 36 is employed and layer 34 is not matched with a finishing overcoating varnish beneath it, layer 34 may be made partially visible. Thus, layer 34 may be made less visible by matching the texture or glossiness between layer 34 and the finishing overcoating varnish on the target article, such as the glossiness of layer 26. If layer 34 has a much "duller" or "shinier" finish compared to layer 26, layer 34 may be made partially visible.

Figure 2:
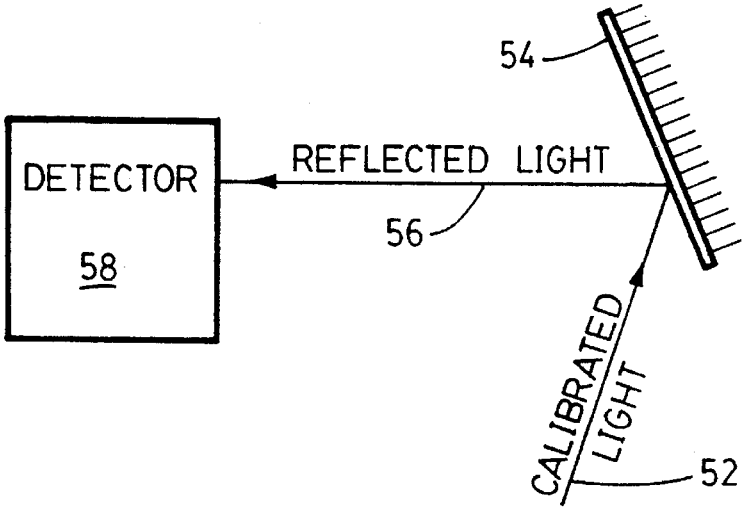
FIG. 2 is a schematic view of a goniophotometer used for measuring the surface glossiness of a surface for determining the glossiness or gloss factor of a surface using the invention to select degree of partial visibility of UV-sensitive material to illustrate the invention.

In reference to item (5) above concerning texture matching, it is possible to measure the partial visibility of layer 34 by determining the glossiness or gloss factor of layer 34 compared to that of an overcoat or other type of finishing of a target article using a goniophotometer such as illustrated in FIG. 2. A goniophotometer measures the glossiness of gloss factor of a surface as the ratio of intensity of light supplied to the surface to intensity of light scattered or reflected by the surface. In general, the greater the percentage of light scattered or reflected, the more visible is the surface. In reference to FIG. 2, a calibrated light beam 52 is directed towards a surface 54 whose glossiness or gloss factor is being measured. As a result of light 52 supplied to surface 54, the light reflected or scattered by surface 54 is detected by detector 58 to determine the glossiness or gloss factor as the ratio between incident light intensity to reflected or scattered light intensity. To change the glossiness, gloss factor or the surface contrast ratio (by observation) of layer 34, printing aids such as driers, flatteners or brighteners may be added.

Figure 3:
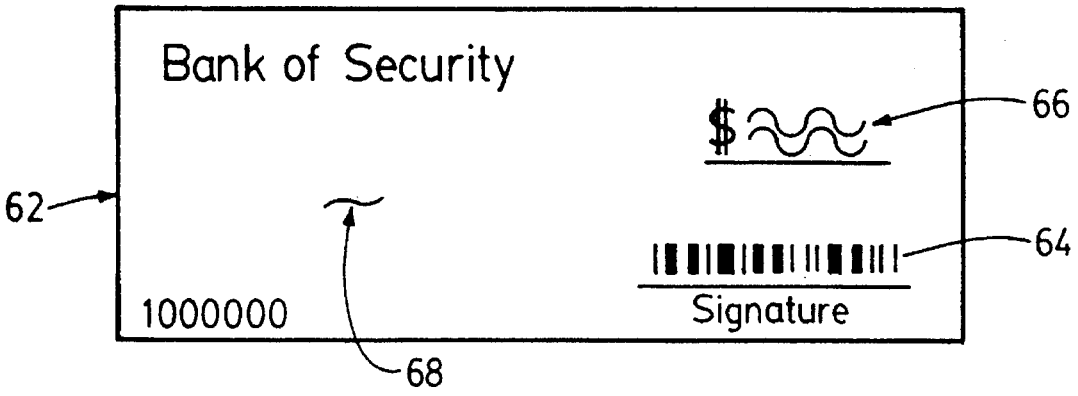
FIG. 3 is a schematic view of a bank check employing the tamper resistant structure of FIGS. 1A, 1B to illustrate the invention.
Figure 4:
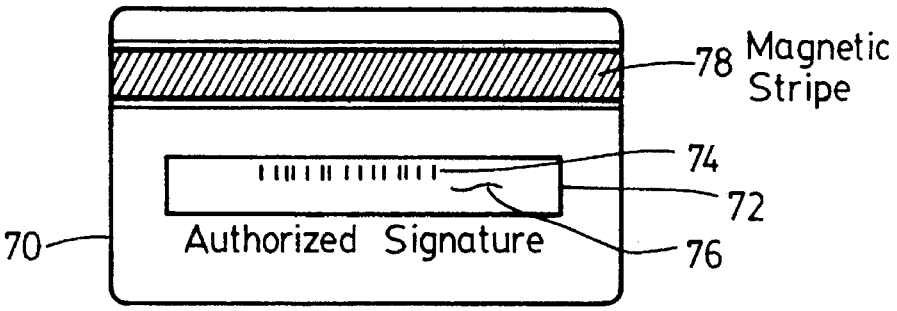
FIG. 4 is a schematic view of a credit card or debit card employing the tamper resistant structure of FIGS. 1A, 1B to illustrate the invention.
Figure 5:
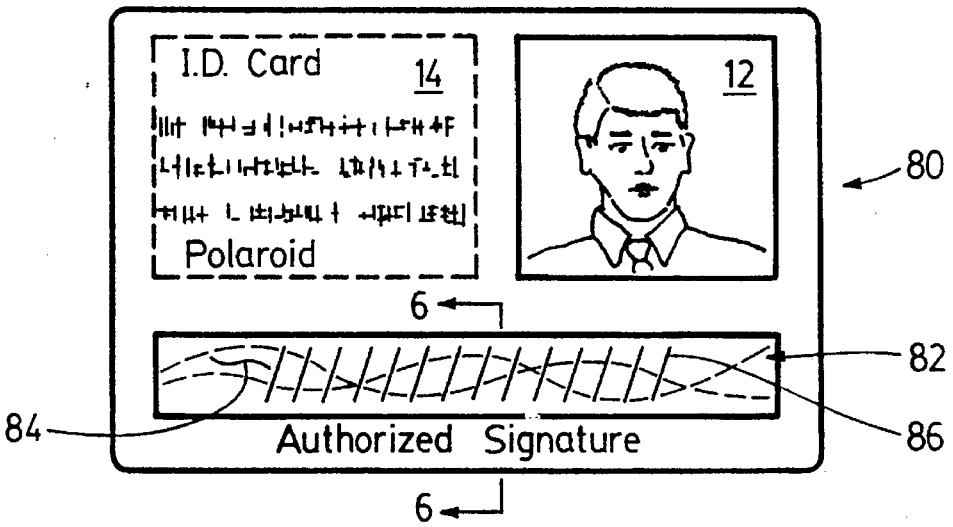
FIG. 5 is a schematic view of an identity card employing the tamper resistant structure of FIGS. 1A, 1B to illustrate the invention.

The above-described structure 20 may be applied to a variety of documents such as a bank check, a credit or debit card, or an identity card, shown in FIGS. 3–5. As shown in FIG. 3, on the bank check 62 are provided a structure 64 of a type similar to structure 20 of FIG. 1A with the ultraviolet radiation fluorescent chemical forming invisible bar codes to identify the signator. If the signature is tampered with, at least a portion of the bar code will be erased or altered to enable detection of fraud. Bank check 62 is also provided with a structure 66 similar to structure 20 of FIG. 1A where the ultraviolet radiation fluorescent chemical forms a pattern of invisible wavy lines. Again, any tampering is likely to cause a portion of the wavy line to be removed or disturbed, thereby enabling detection. 0n bank check 62 are also printed other messages or images as would normally be provided on the bank check.

In FIG. 4, a credit or debit card 70 has thereon a security region 72 for an authorized signature. Card 70 is provided with structures 74, 76 each similar to structure 20 of FIG. 1A. The ultraviolet radiation fluorescent chemical in structure 74 may form invisible bar codes for identification of the signator. The ultraviolet radiation fluorescent chemical in structure 76 may form invisible erasable background patterns. The chemical in structures 74 and 76 may differ to provide additional protection against fraud. Thus, if structure 74 contains a yellow fluorescent chemical while structure 76 contains a green fluorescent chemical or a yellow fluorescent chemical but with different frequency reflection than that of structure 74, such differences can be detected and identified using advanced UV scanners or UV spectrometers. These features render it very difficult for counterfeiters to duplicate structures 74, 76.

Figure 6:
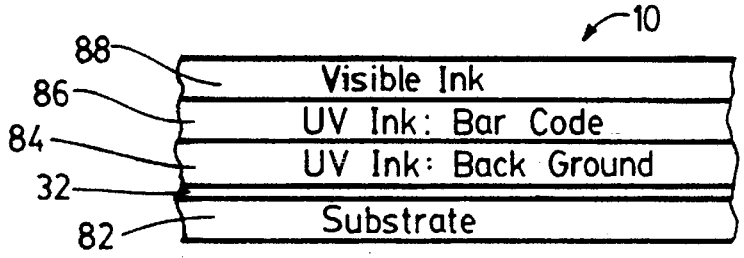
FIG. 6 is a cross-sectional view of a portion of the identity card of FIG. 5 along the line 6—6 in FIG. 5.

Identity card 80 in FIG. 5 has a security region 82 thereon on which are provided a release agent layer 32 shown in FIG. 6 which is a cross-sectional view of region 82 and the security layers along line 6—6 in FIG. 5. On layer 32 is applied a first ultraviolet radiation fluorescent layer 84 similar to layer 34 of FIG. 1A forming an erasable background pattern. On top of layer 84 is provided yet another layer 86 similar to layer 34 of FIG. 1A forming bar codes containing personal identity information. On top of layers 84 and 86 is a layer of visible ink formed when the person signs in region 82. Therefore, when the signature layer 88 is tampered with, this may cause a portion of layers 86 or 84 or both to be removed or altered, thereby enabling fraud detection. Where the layers 84 and 86 overlap, and particularly where they have different fluorescence frequencies, they would be particularly difficult for counterfeiters to duplicate.

Figure 7A:
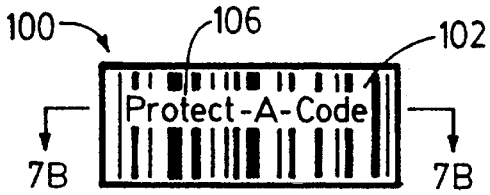
FIG. 7A is a top view of a tamper resistant security label to illustrate the invention.
Figure 7C:
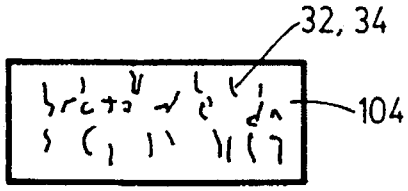
FIG. 7C is a top view of a portion of the security label of FIG. 7A after the label substrate has been removed to illustrate the invention.
Figure 7B:
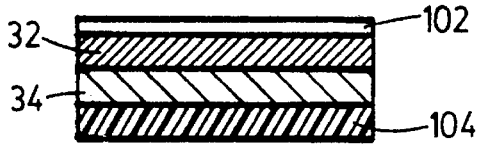
FIG. 7B is a cross-sectional view of the label in FIG. 7A along line 7B—7B in FIG. 7A.

Another aspect of the invention is directed towards a tamper resistant security label illustrated in FIGS. 7A–7D. FIG. 7A is a top view of a security label 100. FIG. 7B is a cross-sectional view of label 100 of FIG. 7A along the line 7B—7B in FIG. 7A. Preferably, the entire label 100 is transparent. As shown in Figs. 7A, 7B, label 100 includes a label substrate 102 which may be a thin transparent film of mylar or similar clear, flexible polymer. Substrate 102 is coated with a layer 32 of release agent on bottom of which is applied a layer of ultraviolet radiation fluorescent material 34 preferably forming a predetermined pattern. On layer 34 is applied an adhesive layer 104. Images or text 106 may be printed on the exposed surface of substrate 102. To enable fraud detection, label 100 is applied to a target article so that adhesive layer 104 is in contact with the article. The pattern formed by layer 34 may then be read using a UV scanner or a black light source.

Figure 7D:
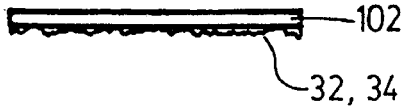
FIG. 7D is a cross-sectional view of a label substrate that has been removed from that of FIG. 7A to leave the structure shown in FIG. 7C to illustrate the invention.

FIG. 7C is a top view of label 100 after substrate 102 has been peeled and FIG. 7D is a cross-sectional view of the substrate 102 and portions of layers 32, 34 after the substrate has been peeled. When substrate 102 is peeled, depending on the tackiness or degree of "release capability" of layers 32, 104, portions of layer 34 may remain on the target article because of adhesion to adhesive layer 104. Again, depending on the tackiness of layers 32, 104, portions of layer 32 and 34 may be removed together with substrate 102 and remain in contact with substrate 102 as shown in FIG. 7D. Therefore, by choosing the relative tackiness of layers 32, 104, it is possible to vary the amount of layers 32, 34 that will remain on the target article as compared to the amount that would be removed by adhering to the substrate 102 when the substrate is peeled.

The tackiness of layers 32 and 104 may be selected by ASTM method of tackiness by adjusting the amount of a tacking agent added to an adhesive or a release chemical to make it more or less capable of releasing the UV-sensitive material. One possible release agent that may be used is low specific gravity syloid flattening LSGSF agent from Davidson and Dugussa of Wanaford, N.J.

In some cases, it may be desirable to provide additional layers between any two adjacent layers in label 100, such as one or more visible ink layers for displaying text or images. After the substrate 102 has been peeled, the pattern on the article formed by layer 34 may either be removed or altered so as to be detectable by means of a UV scanner or a black light source.

Figure 7E:
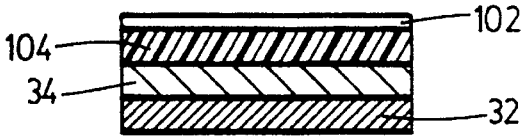
FIG. 7E is a cross-sectional view of the label in FIG. 7A similar to the view of FIG. 7B but with a modified structure to illustrate another embodiment of the label.
Figure 7F:
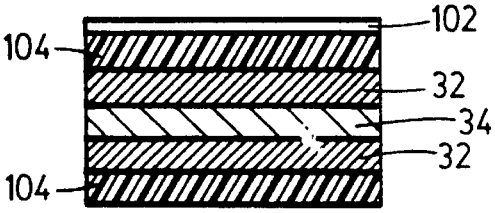
FIG. 7F is a cross-sectional view of the label in FIG. 7A similar to the view of FIG. 7E but with a modified structure to illustrate still another embodiment of the label.
Figure 7G:
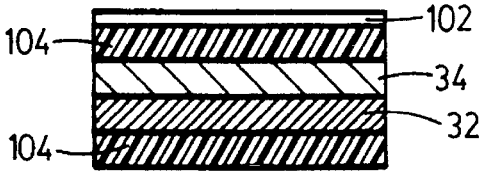
FIG. 7G is a cross-sectional view of the label in FIG. 7A similar to the view of FIG. 7E but with a modified structure to illustrate yet another embodiment of the label.

FIG. 7E is a cross-sectional view of the label in FIG. 7A similar to the view of FIG. 7B but with a modified structure to illustrate another embodiment of the label. The label in FIG. 7E has the same layers as the label of FIG. 7B but arranged in a different order. Thus, the positions of the adhesive layer 104 and of the release coating 32 in FIG. 7E are reversed compared to those in FIG. 7B. With the arrangement of FIG. 7E, layer 34 will stay predominantly with the target article when the substrate 102 is peeled. FIGS. 7F, 7G are cross-sectional views of the label in FIG. 7A similar to the view of FIG. 7E but with modified structures to illustrate other embodiments of the label. In addition to the layers of FIG. 7E, the label of FIG. 7F includes an additional layer 104 at the bottom of the label. In addition to the layers of FIG. 7F, the label of FIG. 7G includes an additional layer 32 between the upper adhesive layer 104 and the ultraviolet sensitive layer 34. With the modified label structures in FIGS. 7F, 7G, some of the layer 34 will stay with the substrate and some will be removed together with the substrate when the substrate is peeled where random portions will stay or be removed, making it difficult for counterfeiters to restore the images on layer 34 once the substrate is peeled as explained below in reference to FIG. 9B. Adhesive layer 104 may be formed using a material that is thermoset, or is curable by means of ultraviolet, microwave or ultrasonic energy.

Figure 8:
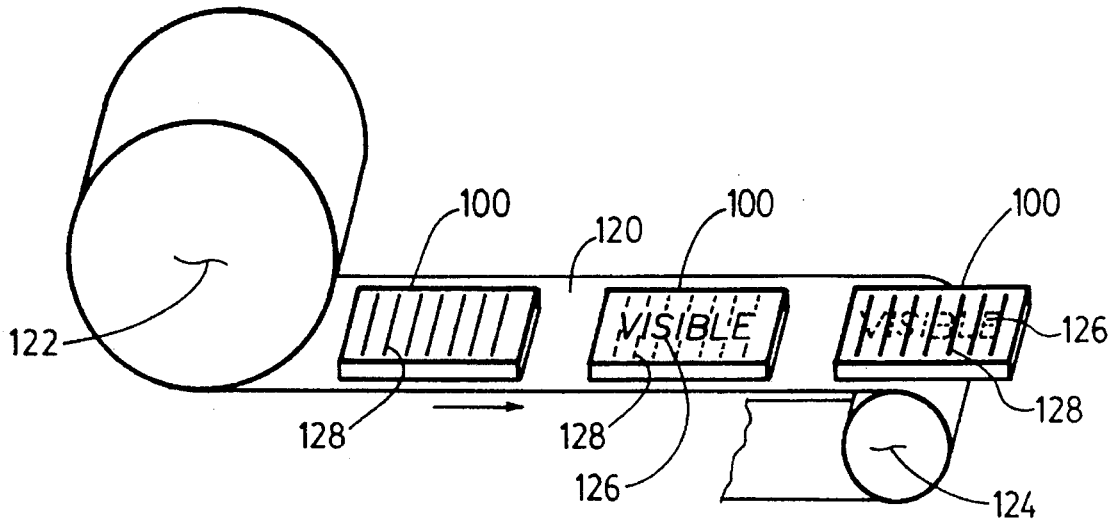
FIG. 8 is a perspective view of a roll of tape with security labels thereon, a tape reel, and a takeoff roller illustrating how the tamper resistant security label of FIG. 7A–7D may be stored and used.

FIG. 8 is a perspective view of a system for storing and using security labels such as label 100 in FIG. 7A. As shown in FIG. 8, labels 100 may be stored on a tape 120 wound around a tape reel 122 so that the labels 100 can be stored on reel 122. When labels 100 are to be used, tape 120 may be wrapped around a takeoff roller 124. Tape 120 is such that adhesive layer 104 of labels 100 would not adhere to the tape so that label 100 may be readily retrieved from the tape for application on target articles. As shown in FIG. 8, labels 100 may contain optional visible images or messages 126 or invisible, ultraviolet radiation fluorescent images or messages, bar codes, or other optically recognizable codes and images, such as those provided by layer 34 in FIG. 7B.

Figure 9A:
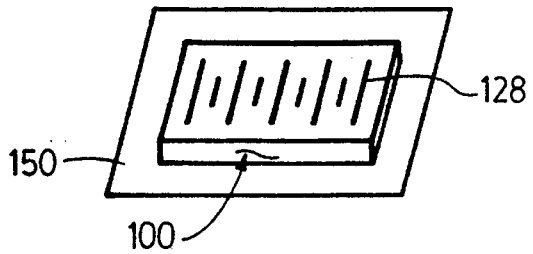
FIG. 9A is a schematic view of a tamper resistant security label as applied to a target article where the label includes a predetermined pattern of UV-sensitive material sandwiched between two layers that adhere to the UV-sensitive layer material.
Figure 9B:
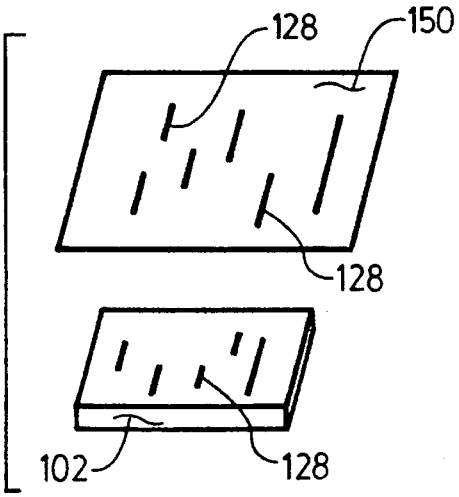
FIG. 9B illustrates the article and a portion of the label after the label substrate has been removed from the article so that a portion of the UV-sensitive material remains on the article while a portion of such material came off together with the label substrate to enable the detection of fraud.
Figure 9C:
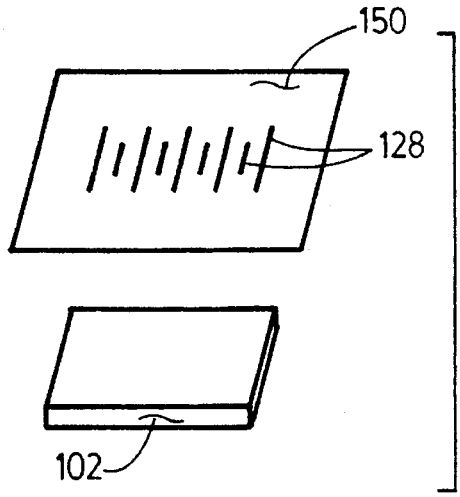
FIG. 9C illustrates the article and the label substrate after the substrate has been removed where the pattern remains intact on the article to illustrate the invention.

The variations that can be achieved with different tackiness of layers 32 and 104 of FIG. 7A are illustrated in FIGS. 9A–9C. As shown in FIG. 9A, label 100 is placed on target article 150. Label 100 includes a layer 128 containing an ultraviolet radiation fluorescent chemical similar to layer 34 of FIG. 7B, the chemical forming a pattern of parallel long and short lines. FIG. 9B illustrates the article and the label after the label substrate 102 has been peeled off. As illustrated in FIG. 9B, the relative tackiness of layers 32 and 104 are chosen such that portions of the ultraviolet radiation fluorescent layer 128 will remain on the article 150 while portions of layer 128 will be peeled off together with the substrate 102 so that the pattern formed by layer 128 on article 150 is drastically altered compared to pattern 128 in FIG. 9A. Therefore, even if a counterfeiter attempts to replace the label by placing a different label substrate on top of article 150, the alteration in the pattern formed by layer 128 on article 150 after tampering can be detected using a UV scanner or a black light source. FIG. 9C illustrates the situation where the relative tackiness of layers 32 and 104 are chosen such that all of layer 128 will remain on article 150 and essentially none of layer 128 will be peeled off together with label substrate 102. In such circumstance, it may be possible for a counterfeiter to place a different label substrate on top of layer 128 and article 150. Not illustrated is the situation where the relative tackiness of layers 32,104 is chosen such that essentially all of layer 128 will be peeled off together with substrate 102 leaving essentially none on article 150. In such circumstance, the label substrate that has been peeled off can potentially be reused on the same or different article which may be undesirable. Therefore, as illustrated above, preferably, the relative tackiness of layers 32 and 104 is such that part of layer 128 will remain with article 150 while part of it will be peeled off together with label substrate 102, where which parts will remain or be removed are substantially at random.

The relative tackiness of the adhesive layer to the release layer depends on their relative peel strengths. Peel strength measured in grams per square centimeter can be performed by PSTC Appendage B test using Slip/Peel testers manufactured by IMASS, Inc. of Accord, Mass. To obtain the result that random parts of the layer 34 will remain on or be removed from the target article, the peel strength of the release layer is preferably 40% to 60% less than the peel strength of the adhesive layer. To achieve such range of relative peel strengths, the peel strengths of either or both layers may be altered using a variety of formulation additives to a base adhesive to make it softer, more tacky, and with extenders and fillers. Some common additives are:

(1) Softeners additives: Beeswax, coal tar oils, vegetable oils, paraffin waxes, stearic acid, polyolefin waxes;

(2) Tackifiers: Rosin, hydrocarbon reins, terpene derivatives;

(3) Thickeners: Guar gum, locust bean gum, hydroxyethyl cellulose, starches, magnesium oxides; and (4) Extenders and fillers: Barium sulfates, calcium carbonates, rosin derivatives, silices and fummed silicas, terpene resins, bentonites.

Figure 10A:
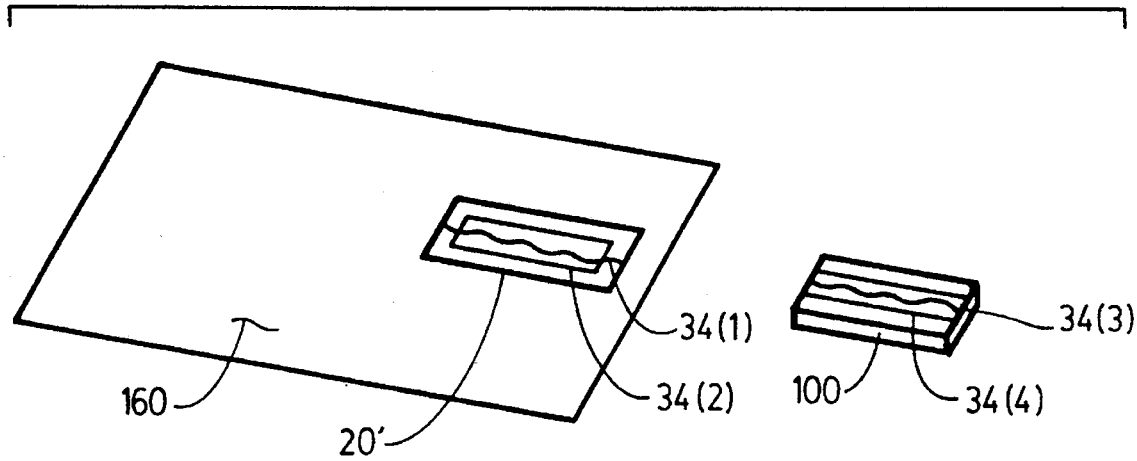
FIG. 10A is a schematic view of a target article with a tamper resistant structure of FIGS. 1A, 1B thereon and a separate security label of FIG. 7A where the label and structure have matching patterns of UV-sensitive material, so that by aligning the matching patterns before the label is applied on top of the structure, the combined structure and label further enhances the capability of fraud detection to illustrate the preferred embodiment of the invention.
Figure 10B:
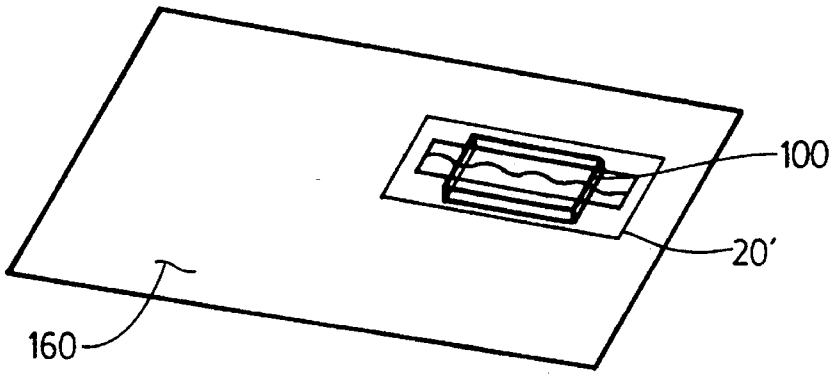
FIG. 10B is a schematic view of the article, tamper resistant structure and the security label of FIG. 10A but where the label has been applied on top of the structure with the matching patterns aligned.

The above-described tamper resistant structure 20 of FIG. 1A and the security label in FIGS. 7A, 7B may be combined to further enhance fraud detection. Such feature is illustrated in FIGS. 10A, 10B. FIG. 10A is a schematic view of a document 160 having thereon a tamper resistant structure 20' similar generally to structure 20 of FIG. 1A but differs from structure 20 in that it has two different ultraviolet radiation fluorescent layers: 34(1) forming a wavy pattern and 34(2) which is a background pattern. Also shown in FIG. 10A is label 100 also with two ultraviolet radiation fluorescent layers: 34(3) in the form of a wavy pattern matching the pattern of layer 34(1) and the background pattern layer 34(4) matching the pattern of layer 34(2) of structure 20'. Thus, a particularly powerful system will be constructed by placing label 100 on top of structure 20' so that the pattern of layer 34(4) of label 100 matches and is aligned with the pattern of layer 34(2) of structure 20', and where the wavy pattern of layer 34(3) of the label also matches and is aligned with layer 34(1) of structure 20' as shown in FIG. 10B. Different applications of the above-described system will be illustrated below in reference to FIG. 11A.

Figure 11A:
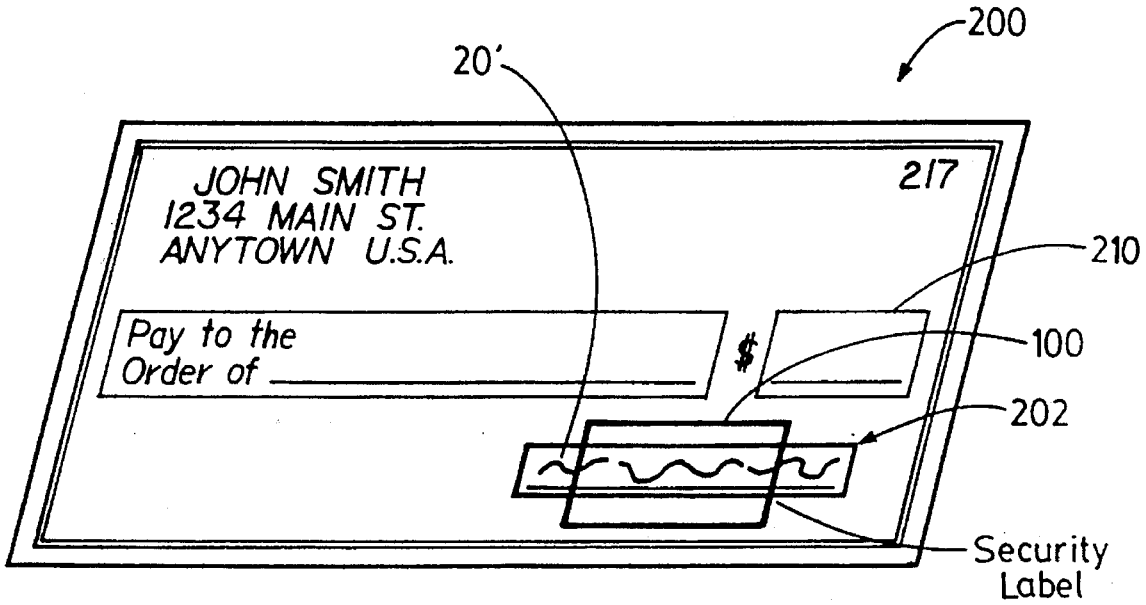
FIG. 11A is a schematic view of a bank check illustrating one possible application of the preferred embodiment of FIGS. 10A, 10B.

As shown in FIG. 11A, bank check 200 has a signature area 202 thereon on which is placed structure 20' illustrated above in FIG. 10A. After the check is signed, an ink signature layer appears on top of structure 20'. In such circumstances, the signature ink layer would obscure portions of the wavy pattern 34(1) as well as the background pattern 34(2) of structure 20'. After bank check 200 has been signed, label 100 is placed on top of the signature and of structure 20' so that the wavy pattern 34(3) matches that of pattern 34(1) and pattern 34(4) matches that of pattern 34(2) as discussed above. In such circumstances, patterns 34(3), 34(4) would be above the ink signature layer so that to a UV scanner or to an observer using a black light source, the wavy pattern on check 160 as well as the background pattern would appear to be intact and continuous. However, if the label substrate is peeled thereby removing some of the layers 34(3), 34(4) of the label and a different tape substrate is placed on top of structure 20', the portions of the layers 34(3), 34(4) that are peeled off together with the label substrate may cause the ink signature not to be covered so as to break the continuity of the wavy pattern or of the background pattern when scanned by a UV scanner or when viewed using a black light source. If, in addition to peeling off the label substrate, the signature itself is tampered with, layers 34(1), 34(2) may also be removed or disturbed, where such alteration is also readily detectable using a UV scanner or a black light source. Thus, the combination of the security label together with the tamper resistant structure 20 renders it particularly difficult for a counterfeiter to replicate. The above scheme may also be advantageously used for authenticating container seals, seals on bottle caps and seals of artwork, documents and document envelopes.

Figure 11B:
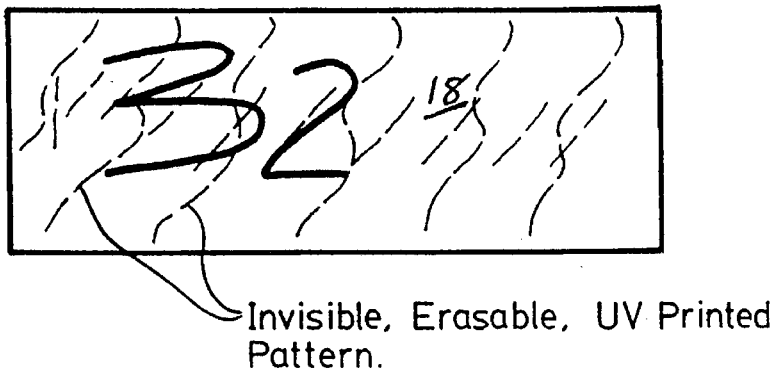
FIG. 11B is a schematic view of an invisible, transparent, erasable pattern of a UV-sensitive material to illustrate the invention.

FIG. 11B is a schematic view of area 210 of check 200 illustrating patterns of the invisible, erasable ultraviolet radiation fluorescent material that can be used in this invention.

Figure 12:
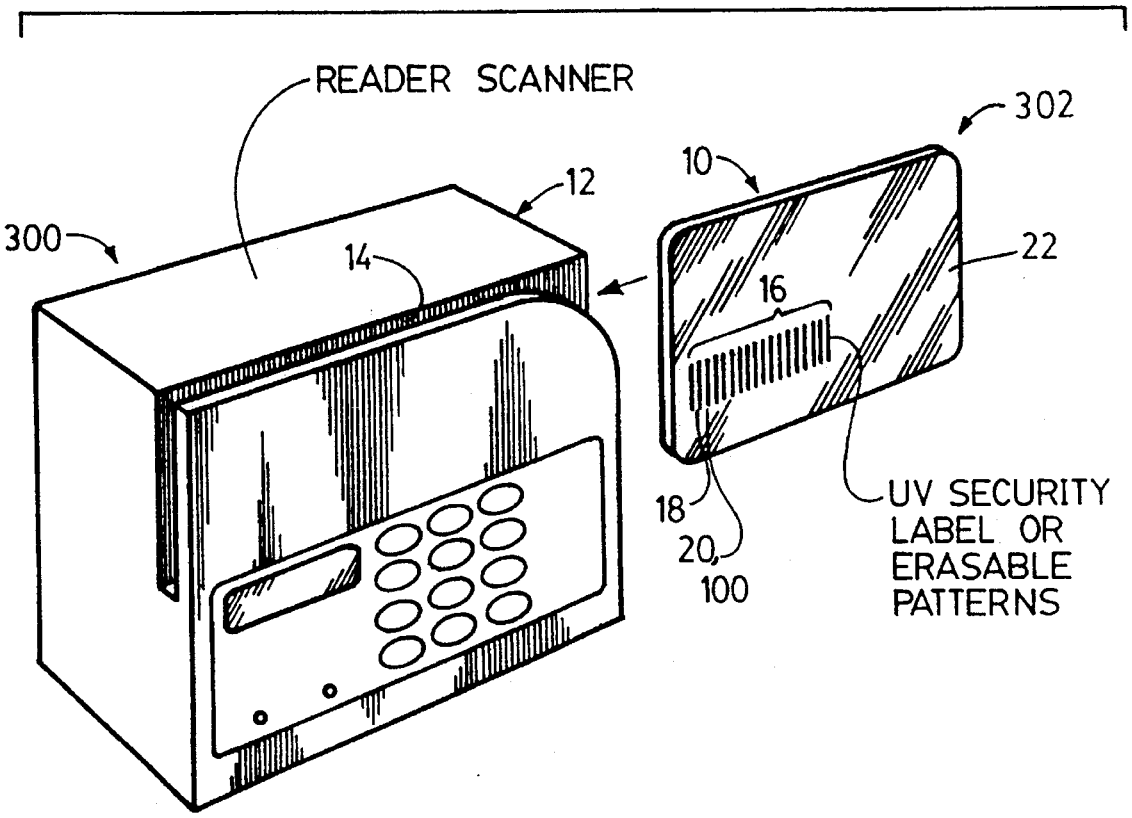
FIG. 12 is a perspective view of a UV scanner and an access card with the security label of FIG. 7A or the tamper resistant structure of FIGS. 1A, 1B to illustrate the invention.
Figure 13:
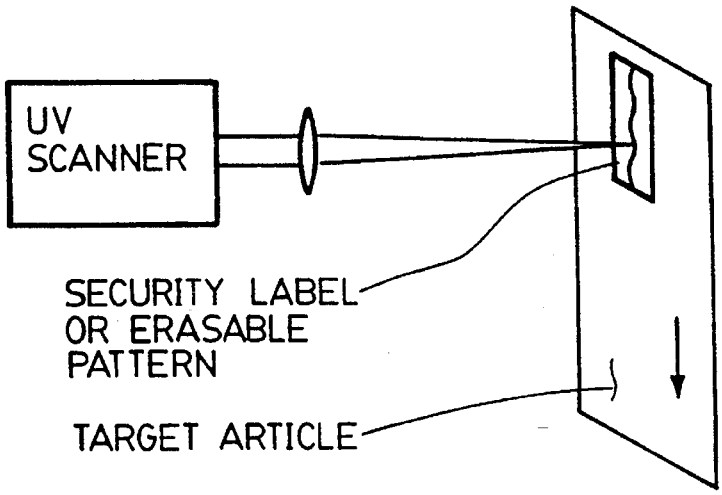
FIG. 13 is a schematic view of a UV scanner and a target article with a security label of FIG. 7A or the tamper resistant structure of FIGS. 1A, 1B to illustrate the operation of the apparatus in FIG. 12.

FIG. 12 is a perspective view of a UV scanner 300 and an access card 302 with either security label 100 or tamper resistant structure 20 to illustrate the process for authentication of card 302. FIG. 13 is a schematic view illustrating the operation of scanner 300. As shown in FIG. 13, scanner 300 scans label 100 or structure 20 and compares the detected pattern of the ultraviolet radiation fluorescent chemical and compares such pattern to known security patterns in order to detect any signs of tampering.

While the invention has been described above by reference to preferred embodiments, it will be understood that various changes and modifications may be made without departing from the scope of the invention which is to be limited only by the appended claims.

What is claimed is:

1. A method for marking articles for enabling the detection of fraud through tampering of articles, comprising:

printing a first layer of a release agent over the article; and forming a second layer of a material in a predetermined first pattern over the release agent layer so that the first layer is between the article and the second layer, wherein the material fluoresces in response to ultraviolet radiation to enable detection of tampering.

2. The method of claim 1, wherein said applying step applies wax, polyolefins, or non-vinyl varnish over the article.

3. The method of claim 1, said material including ultraviolet radiation fluorescent chemical, said method further comprising preparing a suspension of said ultraviolet radiation fluorescent chemical, wherein said forming step includes applying the suspension over the release agent layer.

4. The method of claim 3, wherein said preparing step prepares said suspension by suspending said chemical in an oleoresinous varnish printing vehicle, or in a petroleum based wax or organic wax printing vehicle.

5. The method of claim 3, said preparing step loads the suspension with 5% or more of said chemical so that the material is at least partially visible in the absence of ultraviolet radiation.

6. The method of claim 3, said preparing step loads the suspension with a second chemical so that the material is visible in the absence of ultraviolet radiation.

7. The method of claims 3, said article having a predetermined finish, wherein said preparing step prepares the suspension by suspending said chemical in a carrier, said method further comprising selecting a carrier that results in a finish less similar in glossiness to the finish of the article so that the material is at least more partially visible in the absence of ultraviolet radiation.

8. The method of claim 3, said article having a predetermined finish, wherein said preparing step prepares the suspension by suspending said chemical in a carrier, said method further comprising selecting a carrier that results in a finish similar in glossiness to the finish of the article so that the material is less visible in the absence of ultraviolet radiation.

9. The method of clam 3, said preparing step including adding to the suspension printing aids to alter a surface contrast ratio of the suspension when it is dried.

10. The method of claim 9, further comprising checking the ratio of transmitted light to scattered light of the carrier after it is dried using a goniophotometer.

11. The method of claim 1, further comprising the step of providing a varnish layer over the article before or after the forming step to render the material at least more or less partially visible respectively.

12. The method of claim 1, said forming step including printing said second layer of material.

13. The method of claim 1, further comprising detecting said first pattern by means of a UV scanner to detect fraud through tampering of the article.

14. The method of claim 1, wherein said forming forms the second layer so that the layer is visible or partially visible in the absence of ultraviolet light to facilitate unaided visual authentication.

15. The method of claim 1, wherein said forming forms the second layer on said first layer.

16. A method for safeguarding articles against tampering, comprising:

applying a first layer of a release agent over an article;

forming a second layer of a material in a predetermined first pattern over the release agent layer so that the first layer is between the article and the second layer, wherein the material fluoresces in response to ultraviolet radiation; and applying an authenticating layer over said second layer, so that tampering is detectable when the material exhibits a pattern different from the first pattern.

17. The method of claim 16, said applying comprising signing an authenticating signature over said second layer.

18. The method of claim 16, further comprising detecting said first pattern by means of a UV scanner to detect tampering of the article.

19. The method of claim 16, said forming forms the second layer so that the layer is visible or partially visible in the absence of ultraviolet light to facilitate unaided visual authentication.

20. The method of claim 16, said applying comprising forming a visible ink layer over said second layer.

21. An article protected against tampering, comprising:

a first layer of a release agent over an article;

a second layer of a material in a predetermined first pattern in contact with the release agent layer so that the first layer is between the article and the second layer, wherein the material fluoresces in response to ultraviolet radiation; and a third authenticating layer over said second layer, so that tampering is detectable when the material exhibits a pattern different from the first pattern.

22. The article of claim 21, said third layer comprising an authenticating signature pattern.

23. The article of claim 21, said second layer containing a second chemical or having a surface so that the second layer is visible or partially visible in the absence of ultraviolet light to facilitate unaided visual authentication.

24. The article of claim 21, said third layer comprising a visible ink.

* * * * *